United States Patent [19]

Heinemann et al.

[11] Patent Number: 4,756,093

[45] Date of Patent: Jul. 12, 1988

[54] APPARATUS FOR HEAT EXCHANGE BETWEEN GAS AND FINE-GRAINED MATERIAL

[75] Inventors: Otto Heinemann, Ennigerloh; Heinz-Herbert Schmits, Rheda Wiedenbrück, both of Fed. Rep. of Germany

[73] Assignee: Krupp Polysius AG, Beckum, Fed. Rep. of Germany

[21] Appl. No.: 42,160

[22] Filed: Apr. 24, 1987

Related U.S. Application Data

[63] Continuation of Ser. No. 794,711, Nov. 4, 1985, abandoned.

[30] Foreign Application Priority Data

Nov. 23, 1984 [DE] Fed. Rep. of Germany ..... 3442806

[51] Int. Cl.[4] ..... F26B 17/10

[52] U.S. Cl. ..... 34/57 R; 34/57 E

[58] Field of Search ..... 34/57 R, 57 E

[56] References Cited

U.S. PATENT DOCUMENTS

| | | | |
|---|---|---|---|
| 638983 | 12/1899 | Osborne | 55/459 R |
| 2,341,671 | 2/1944 | Ter Linden | 55/459 R |
| 3,049,343 | 8/1962 | Helming | 55/345 |
| 3,925,091 | 12/1975 | Yoshida et al. | 34/57 E |
| 4,014,641 | 3/1977 | Shigeyoshi et al. | 34/57 E |
| 4,299,564 | 11/1981 | Herchenbach et al. | 432/58 |
| 4,402,667 | 9/1983 | Goldmann | 432/106 |

*Primary Examiner*—Larry I. Schwartz

*Attorney, Agent, or Firm*—Learman & McCulloch

[57] ABSTRACT

The invention relates to apparatus for heat exchange between gas and fine-grained material containing a plurality of cyclone-like separators which are arranged one above the other and have bent central axes. Such a heat exchanger is distinguished by a particularly compact construction and a good separating capacity of the individual separators.

13 Claims, 9 Drawing Sheets

APPARATUS FOR HEAT EXCHANGE BETWEEN GAS AND FINE-GRAINED MATERIAL

Figure 1:
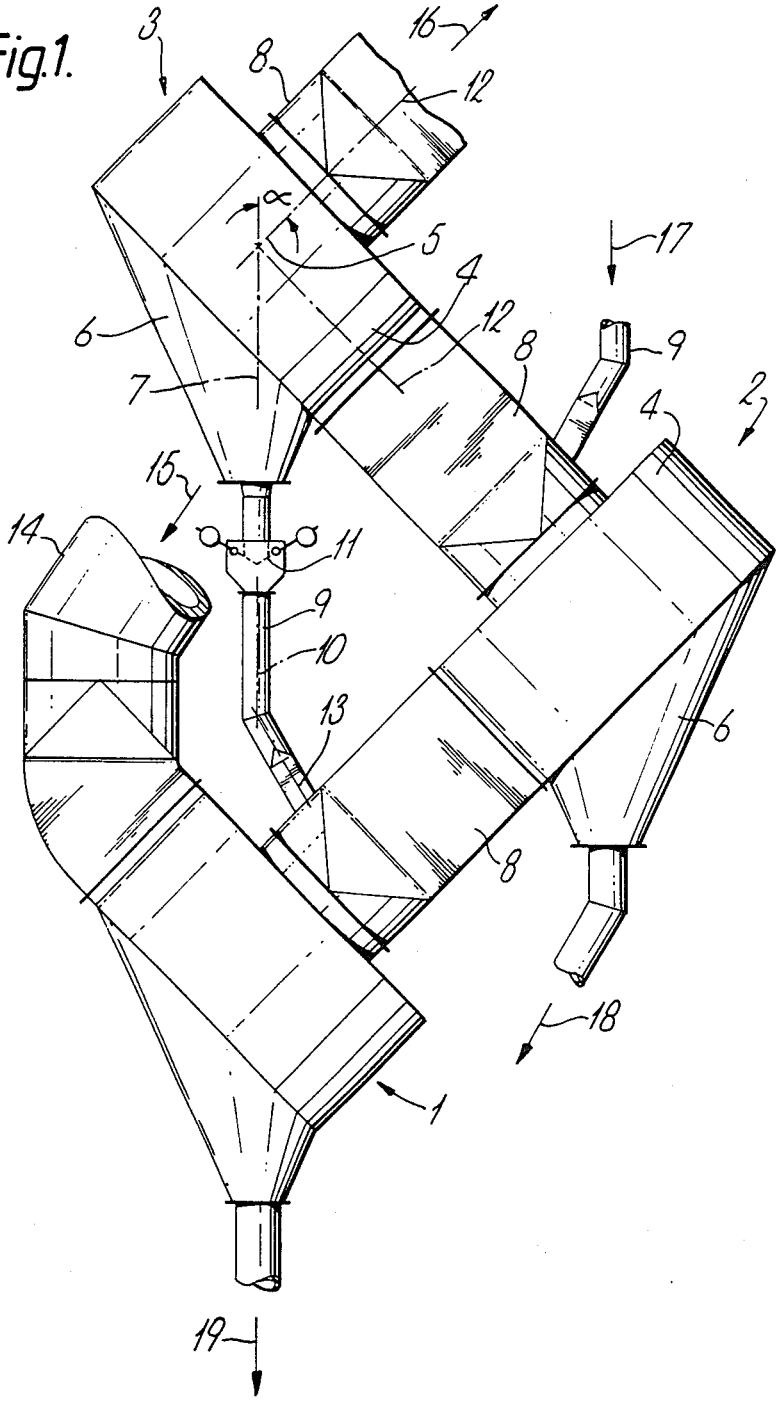

This is a continuation of co-pending application Ser. No. 794,711 filed on Nov. 4, 1985, now abandoned.

The invention relates to apparatus according to the preamble to claim 1.

Apparatus of this type is known from U.S. Pat. No. 3,094,343 to Helming. The cyclone-like separators of this known apparatus consist of a cylindrical body which is inclined by an angle of approximately 45° relative to the vertical and to which is connected the funnel-shaped material discharge pipe which extends at right angles to this cylindrical body (and thus is also inclined by an angle of approximately 45° relative to the vertical).

The object of the invention is to make further developments to the apparatus according to the preamble to claim 1 in such a way that the design and construction are simplified and at the same time the separating conditions are improved.

This object is achieved according to the invention by the characterising features of claim 1.

In contrast to the known construction described in the introduction, in the apparatus according to the invention the main body of the cyclone-like separator is not constructed over its whole height as a cylinder (with a straight axis) but is composed of two parts with their axes angled relative to one another: the upper part of the separator forms the same angle with the vertical as the axis of the adjoining gas pipe, whilst the axis of the lower part of the separator encloses a smaller angle with the vertical. In this way a construction is provided which is compact and saves on material and moreover is distinguished by excellent separation and reliable discharge of material without blockages.

Advantageous constructions of the invention are the subject matter of the subordinate claims and are explained in connection with the following description of several embodiments which are illustrated in the drawings.

Figure 2:
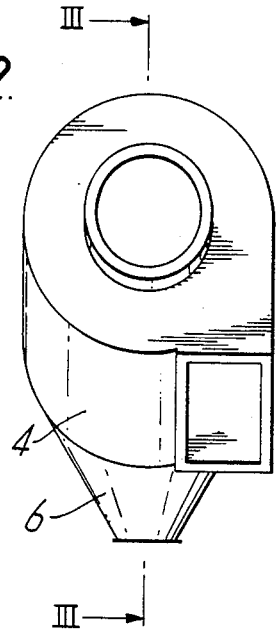
Figure 3:
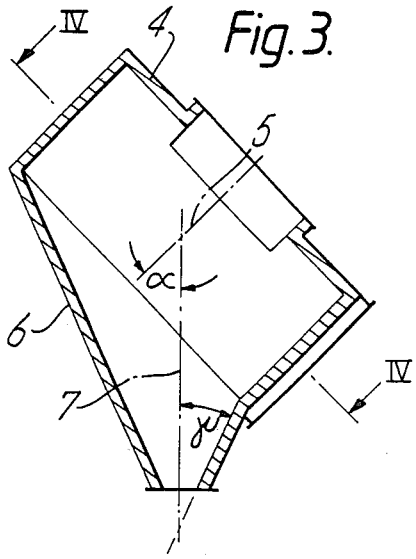
Figure 4:
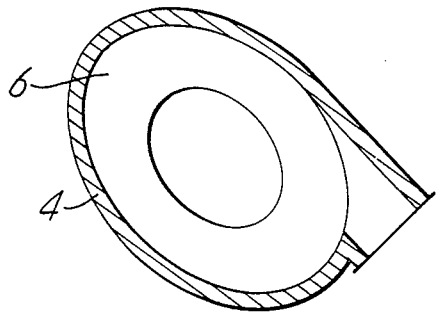
Figure 5:
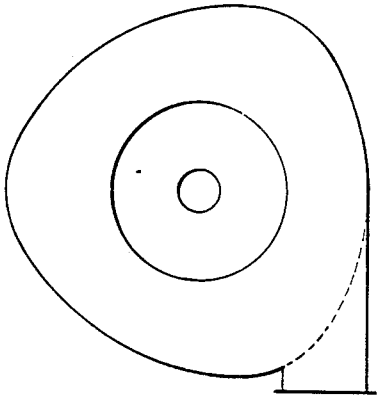
Figure 6:
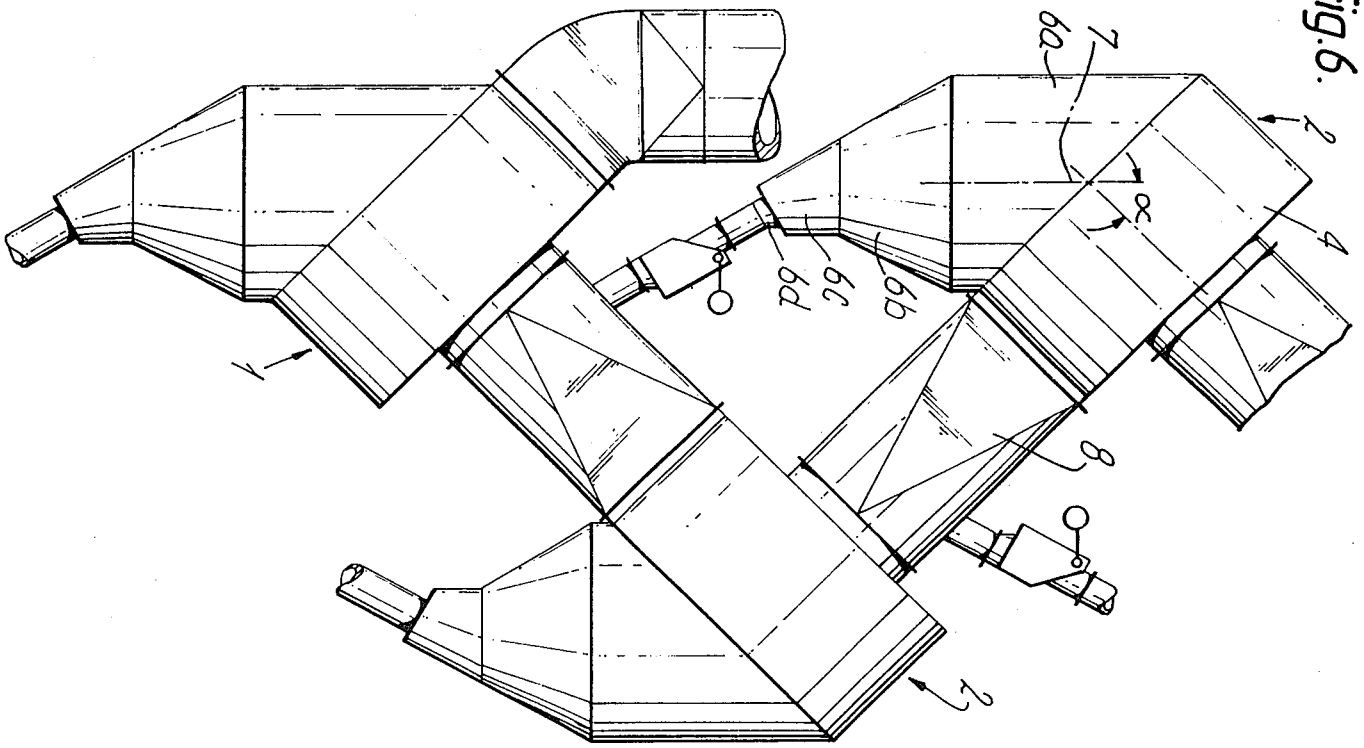
Figure 7:
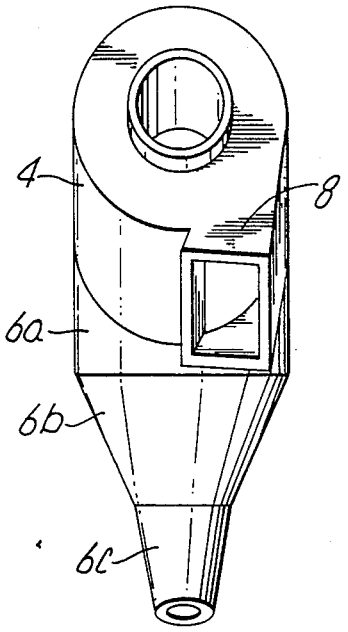
Figure 9:
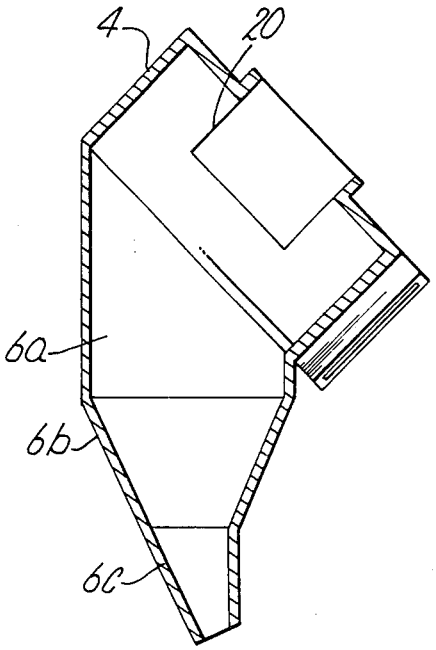
Figure 8:
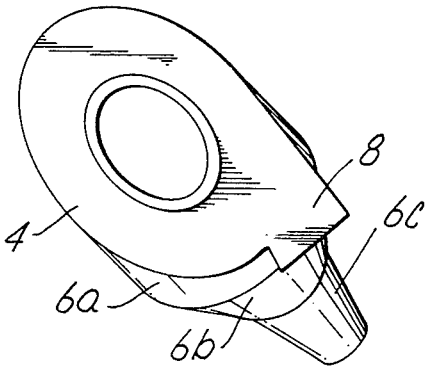
Figure 10:
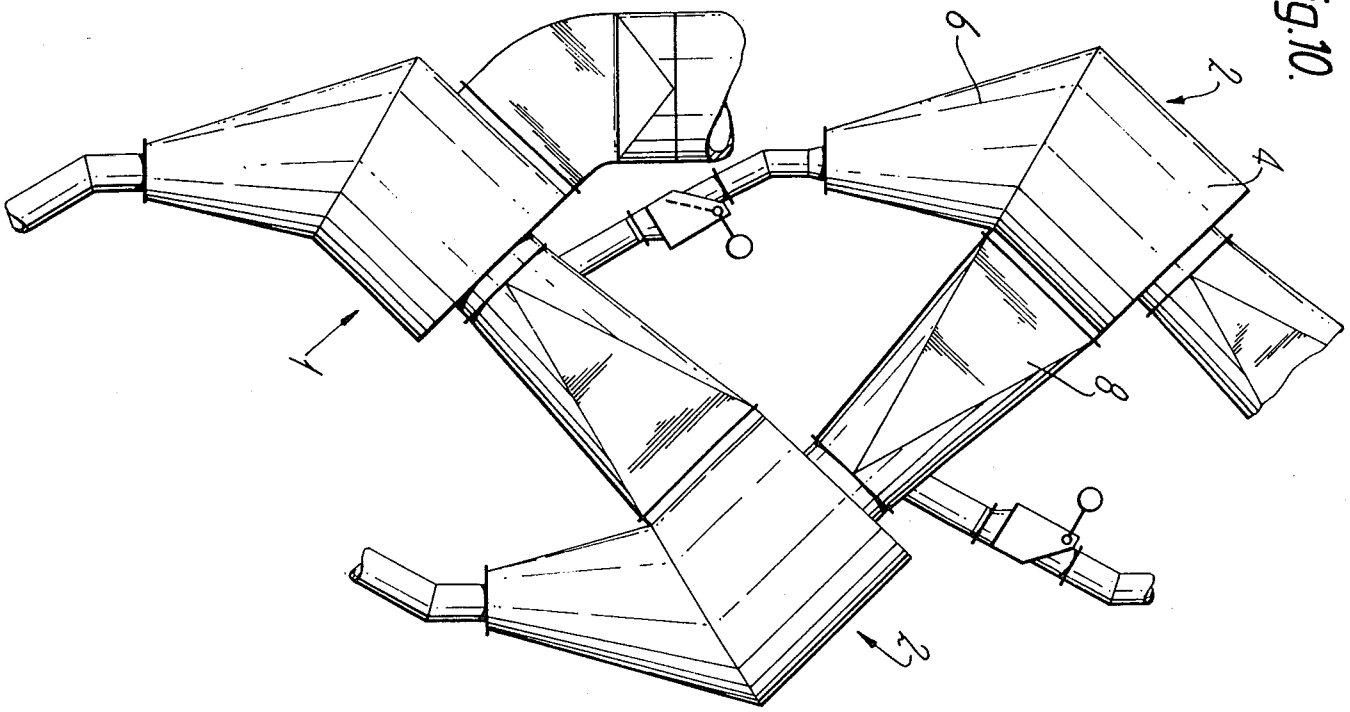
Figure 11:
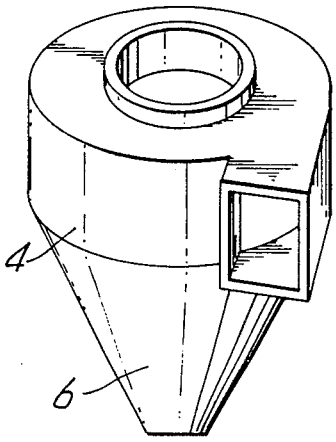
Figure 13:
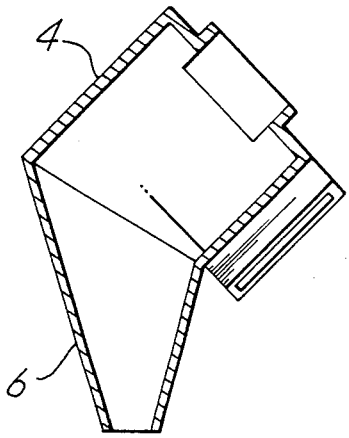
Figure 12:
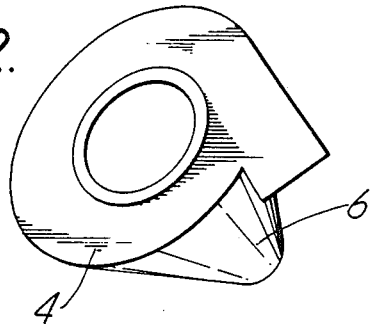
Figure 16:
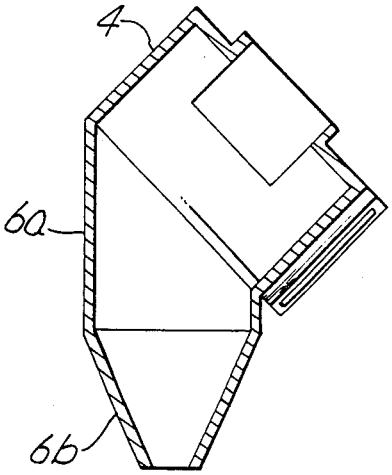
Figure 17:
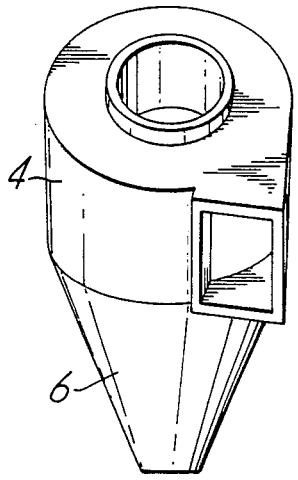
Figure 19:
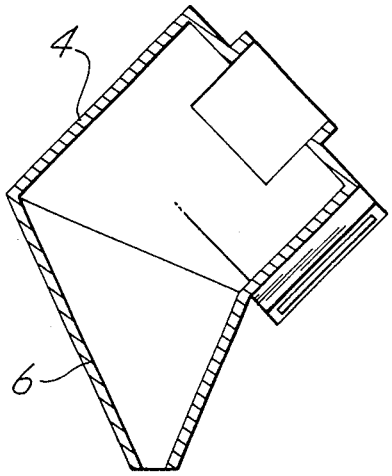
Figure 18:
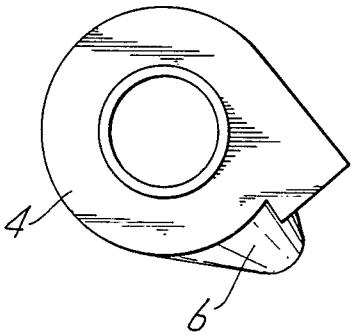
Figure 20:
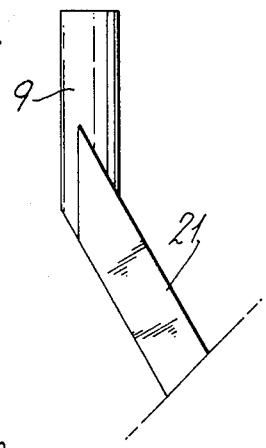
Figure 21:
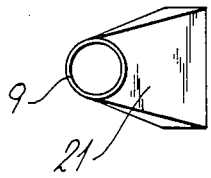
Figure 22:
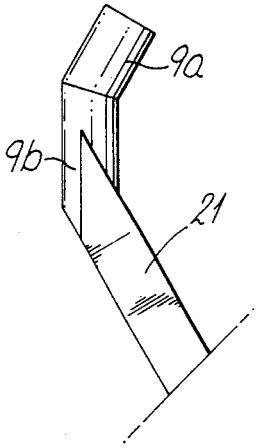
Figure 23:
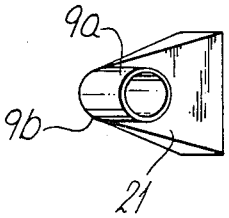
Figure 24:
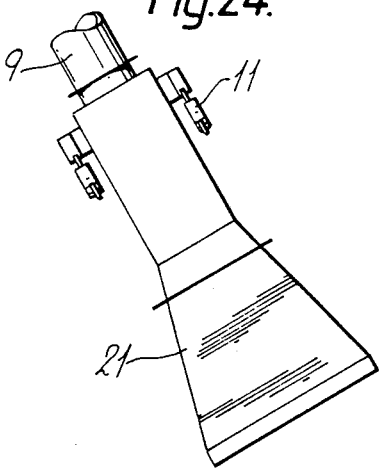
Figure 25:
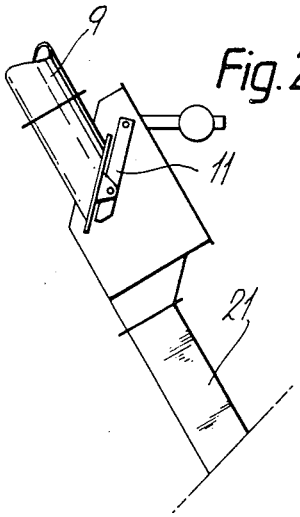

In the drawings:

FIG. 1 shows a partial representation (side view) of apparatus according to the invention, FIG. 2 shows a view of a separator according to FIG. 1, FIGS. 3 and 4 show sections respectively along the line III—III in FIG. 2 and IV—IV in FIG. 3, FIG. 5 shows a plan view of a further embodiment of a separator, FIG. 6 shows a side view of a further embodiment, FIGS. 7, 8 and 9 show an elevation, plan view and section of a separator according to FIG. 6, FIG. 10 shows a side view of a further embodiment, FIGS. 11, 12 and 13 show an elevation, plan view and section of a separator according to FIG. 10, FIGS. 14, 15 and 16 show an elevation, plan view and section of a further embodiment of a separator, FIGS. 17, 18 and 19 show an elevation, plan view and section of a further embodiment of a cyclone-like separator, FIGS. 20 and 21 show a side view and plan view of a material discharge pipe with a material distributing chute, FIGS. 22 and 23 show a side view and a plan view of a further variant of the material discharge pipe and the material distributing chute, FIGS. 24 and 25 show a plan view and a side view of a further version of the material distributing chute.

The apparatus for heat exchange between gas and fine-grained material (for example for preheating or cooling) which is illustrated in a partial representation in FIG. 1 consists of a plurality of cyclone-like separators 1, 2, 3 etc. arranged one above another. Each of these separators consists of an upper part 4 (with an axis 5) and a funnel-shaped lower part 6 (with an axis 7).

A gas pipe 8 which leads to the next separator is connected to the upper part 4 of the separator. A material discharge pipe 9 (axis 10) in which for example pendulum valves 11 are arranged and which opens into the gas pipe 8 leading to the separator arranged below it is connected to the lower part 6 of the separator.

The axis 5 of the lower part 4 of the separator coincides with the axis 12 of the gas pipe 8 connected to this separator, and the separators are arranged in such a way that the gas pipes 8 are formed by pipes extending in a straight line.

In the illustrated embodiment the axes 5 and 12 form an angle $\alpha$ of preferably approximately 45° with the vertical, whilst the axis 7 of the lower part 6 of the separator and the axis 10 of the part of the material discharge pipe 9 connected to the lower part 6 preferably coincide with the vertical. The axis 13 of the lowest section of the material discharge pipe 9 is inclined slightly with respect to the vertical in the illustrated embodiment.

In the embodiment illustrated in FIGS. 2 to 4 the upper part 4 of the separator has an essentially elliptical cross-section. The lower part 6 of the separator is constructed in the shape of a funnel, and the wall of this lower part 6 of the separator encloses with the axis 7 of this lower part 6 an angle $\alpha$ which deviates by a maximum of $\pm 30°$ from the angle $\alpha$ which the axis 5 of the upper part 4 of the separator encloses with the vertical.

The cyclone-like separators of the apparatus according to the invention can have a cross-section essentially in the form of a circular cylinder, as is common in the case of cyclones.

However, significantly improved separating conditions can be obtained if the upper part 4 of the separator has an elliptical cross-section (according to FIG. 4) or the cross-sectional shape of a polygon with rounded corners (FIG. 5). With these cross-sectional forms there is a periodic alteration in the gas speed whilst flowing through the separator, which leads to an improvement in the separating capacity, i.e. an increase in the degree of efficiency.

The installation of the heat exchanger illustrated in FIG. 1 in a larger plant is not shown in detail. If the heat exchanger is used for example for heating fine-grained material, such as crude cement material, before firing in a rotary kiln, then the hot gas (exhaust gas from the rotary kiln) is delivered for example via a calcining loop 14 to the lowest separator 1 and then flows through the following separators 2, 3 etc. (arrows 15, 16) in a known manner, whilst the fine-grained material to be preheated is introduced from a higher stage of the preheater via the material discharge pipe 9 into the gas pipe 8 leading from the separator 2 to the separator 3 (arrow 17), after separation in the separator 3 is introduced into the gas pipe 8 leading to the separator 2, is then introduced (arrow 18) into the gas pipe (not shown) leading to the separator 1 and finally is discharged from the separator 1 and passed to the rotary kiln (arrow 19).

FIGS. 6 to 9 show an embodiment in which the separators 1, 2, 3 have an elliptical upper part 4 and a lower part which is composed of a cylindrical section 6*a*, a funnel-shaped section 6*b* and a transition piece 6*c*. The transition piece 6*c* is advantageously rotatable about the axis 7 of the lower part of the separator so that the material discharge opening 6*d* can be pivoted in different directions.

As FIGS. 7 to 9 show, in this embodiment the gas pipe 8 leading to the separator opens into the upper part 4 of the separator 1 approximately parallel to the large axis of the ellipse.

Here—as in all the other embodiments—the length of the dip pipe 20 can be varied.

In the embodiment of the invention illustrated in FIGS. 10 to 13 the upper part 4 of the separators 1, 2, 3 also has an elliptical cross-section, but the height of the upper part 4 of the separator which is inclined relative to the vertical is greater in the higher peripheral region than in the lower peripheral region. In this embodiment the gas pipe 8 leading to the separator opens into the upper part 4 approximately parallel to the small axis of the ellipse.

The lower part 6 of the separator consists in this embodiment of one single funnel-shaped section, the aperture angle of which, however, is kept smaller than in the construction according to FIGS. 1 to 4.

Figure 14:
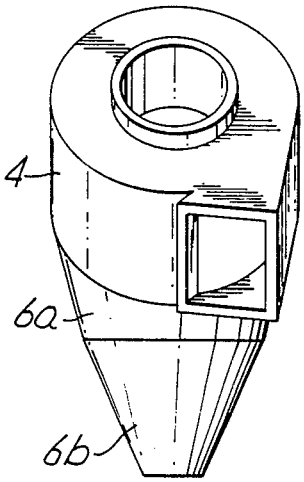
Figure 15:
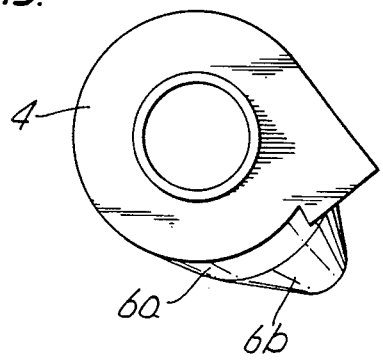

The separator illustrated in FIGS. 14 to 16 contains a cylindrical upper part 4 and a lower part which is composed of a cylindrical section 6*a* and a funnel-shaped section 6*b*.

The variant of a separator illustrated in FIGS. 17 to 19 also contains an upper part 4 of cylindrical cross-section, but a lower part 6 which is formed by one single funnel or cone. The cylindrical upper part 4 and the conical lower part 6 are cut at such an angle $\gamma$ that congruent ellipses are formed for the cylindrical upper part and the conical lower part.

Finally, several variants of the lower end of the material discharge pipe 9 and a connecting chute 21 are illustrated in FIGS. 20 to 25.

In the construction according to FIGS. 20 and 21 the material in dust form which is separated off in a cyclone-like separator falls directly from the vertical material discharge pipe 9 onto the base of a flat chute 21 which widens in a fan shape and is inclined (for example at an angle of 25° to 35° relative to the vertical) and into which the gas pipe leading to the next lower separator opens. Thus the chute 21 acts as a material distributor and ensures that the material is distributed approximately evenly over the cross-section of the gas pipe to enter the latter.

In the variant illustrated in FIGS. 22 and 23, the material falls from an inclined chute part 9*a* of the material discharge pipe 9 through a vertically extending pipe section 9*b* onto the base of the chute 21 which widens in a fan shape. In this embodiment (as in the variant according to FIGS. 20, 21) the chute 21 can widen to between three and five times the diameter of the material discharge pipe 9.

FIGS. 24 and 25 show a variant in which (as shown in FIG. 6) a pendulum valve 11 is arranged in the inclined material discharge pipe 9 and has a round cross-section on the inlet side and angular cross-section on the discharge side. A level chute 21 which widens in a fan shape and effects dispersal of the stream of material over the flat inclined base of the fan-shaped chute is connected to the pendulum valve 11. The inclination of the chute 21 relative to the vertical is also advantageously 25° to 35° here.

We claim:

1. Apparatus for heat exchange between gas and fine-grained material, comprising:

(a) a plurality of separators arranged one above another in a stack to enable material to pass by gravity from an upper separator into an adjacent lower separator;

(b) each separator having a cyclone-like upper part and a downwardly tapering, funnel-shaped lower part;

(c) each cyclone-like upper part having a straight line axis at an angle to the vertical and each separator having its cyclone-like upper part circumferentially offset at approximately 90° from the cyclone-like upper part of each adjacent separator;

(d) each funnel-shaped lower part having a substantially vertical, straight line axis from end to end intersecting and forming with the axis of the cyclone-like upper part an obtuse angle resulting in each separator's having a bent central axis, the funnel-shaped lower part being formed over its entire height substantially as a surface of revolution about its axis and being joined at its larger upper end with the lower periphery of the cyclone-like upper part as a continuation thereof;

(e) a gas pipe inclined relative to the vertical and extending between the cyclone-like upper part of each pair of adjacent separators in a substantially straight line, each such gas pipe extending from an exhaust outlet projecting centrally from the upper face of the next lower cyclone-like part in a substantially straight line to a supply opening communicating tangentially into the side of the next upper cyclone-like part for supply of gas thereto, the axial depth of each cyclone-like upper part being substantially equal to the corresponding transverse dimension of the gas pipe at its supply end opening therein, and the exhaust outlet end of each gas pipe leading from each cyclone-like upper part commencing along the control axis of the next lower cyclone-like upper part at a point along said axis within the transverse extent of the associated gas supply opening as projected along that axis, whereby maximum axial compactness of each cyclone-upper part is achieved; and (f) a material discharge pipe connected to and coaxial with each funnel-shaped lower part and opening into the gas pipe leading to the next adjacent below.

2. Apparatus according to claim 1, wherein the upper part of each separator has a cross-section essentially in the form of a circular cylinder.

3. Apparatus according to claim 2 wherein the lower part of each separator comprises a single conical section, and the cylindrical upper part and the conical lower part are cut at such an angle that congruent ellipses are formed by the cylindrical upper part and the conical lower part.

4. Apparatus according to claim 1 wherein the upper part of each separator has a cross-section essentially in the form of an ellipse.

5. Apparatus according to claim 1 wherein the upper part of each separator has a cross-section essentially in the form of a polygon with rounded corners.

6. Apparatus for heat exchange between gas and fine-grained material, comprising:

(a) a plurality of separators arranged in a generally vertical stack to enable material to pass from one separator into a subsequent lower separator;
(b) each separator having a cyclone-like upper part and funnel-shaped lower part;
(c) each cyclone-like upper part having an axis at an angle to the vertical, the angle being substantially the same for all the separators, and each separator having its cyclone-like upper part circumferentially offset at approximately 90° from the cyclone-like upper part of each adjacent separator;
(d) each funnel-shaped lower part having a substantially vertical axis forming an angle with the axis of the cyclone-like upper part resulting in the separator's having a bent central axis, the funnel-shaped lower part being formed substantially as a surface of revolution about its axis and joined at its larger upper end with the lower periphery of the cyclone-like upper part as a continuation thereof;
(e) a gas pipe inclined relative to the vertical and extending between the cyclone-like upper parts of each pair of adjacent separators in a substantially straight line; and
(f) a material discharge pipe connected to each funnel-shaped lower part at its lower, smaller end and communicating with the gas pipe leading to the next adjacent lower separator;
(g) the upper part of each separator having the cross-sectional shape of an ellipse.

7. Apparatus according to claim 6 wherein the gas pipe leading to each separator enters the upper part thereof approximately parallel to the larger axis of the ellipse.

8. Apparatus according to claim 7, wherein the lower part of the separator contains a cylindrical section and a funnel-shaped section arranged below it.

9. Apparatus according to claim 6 wherein the gas pipe leading to each separator enters the upper part thereof approximately parallel to the smaller axis of the ellipse.

10. Apparatus for heat exchange between gas and fine-grained material, comprising:
(a) a plurality of separators arranged in a generally vertical stack to enable material to pass from one separator into a subsequent lower separator;
(b) each separator having a cyclone-like upper part and a funnel-shaped lower part;
(c) each cyclone-like upper part having an axis at an angle to the vertical, the angle being substantially the same for all the separators, and each separator having it cyclone-like upper part circumferentially offset at approximately 90° from the cyclone-like upper part of each adjacent separator;
(d) each funnel-shaped lower part having a substantially vertical axis forming an angle with the axis of the cyclone-like upper part resulting in the separator's having a bent central axis, the funnel-shaped lower part being formed substantially as a surface of revolution about its axis and being joined at its larger upper end with the lower periphery of the cyclone-like upper part at a continuation thereof;
(e) a gas pipe inclined relative to the vertical and extending between the cyclone-like upper parts of each pair of adjacent separators in a sunstantially straight line; and
(f) a material discharge pipe connected to each funnel-shaped lower part at its lower, smaller end and communicating with the gas pipe leading to the next adjacent lower separator;
(g) the upper part of each separator having the cross-sectional shape of a polygon with rounded corners.

11. Apparatus according to claim 10, wherein the lower part of each separator comprises a single funnel-shaped section, and the height of the upper part of the separator which is inclined relative to the vertical is greater in the higher peripheral region than in the lower peripheral region.

12. Apparatus according to claim 10, including a rotatable transition piece connected to the funnel-shaped section and having a material discharge opening which can be located to open in different directions by rotation of the transition piece.

13. Apparatus for heat exchange between gas and fine-grained material, comprising:
(a) a plurality of separators arranged in a generally vertical stack to enable material to pass from one separator into a subsequent lower separator;
(b) each separator having a cyclone-like upper part and a funnel-shaped lower part;
(c) each cyclone-like upper part having an axis at an angle to the vertical, the angle being substantially the same for all the separators, and each separator having its cyclone-like upper part circumferentially offset at approximately 90° from the cyclone-like upper part of each adjacent separator;
(d) each funnel-shaped lower part having a substantially vertical axis forming an angle with the axis of the cyclone-like upper part resulting in the separator's having a bent central axis, the funnel-shaped lower part being formed substantially as a surface of revolution about its axis and joined at its larger upper end with the lower periphery of the cyclone-like upper part as a continuation thereof;
(e) a gas pipe inclined relative to the vertical and extending between the cyclone-like upper parts of each pair of adjacent separators in a substantially straight line; and
(f) a material discharge pipe connected to each funnel-shaped lower part at its lower, smaller end and communicating with the gas pipe leading to the next adjacent lower separator;
(g) each material discharge pipe communicating with its associated gas pipe via a flat chute which widens in the direction of material flow in a fan shape and acts as a material distributor, each chute widening to between about three and five times the diameter of the material discharge pipe and being inclined at an angle of 25° to 35° relative to the vertical.

* * * * *

UNITED STATES PATENT AND TRADEMARK OFFICE

CERTIFICATE OF CORRECTION

PATENT NO. : 4,756,093

DATED : July 12, 1988

INVENTOR(S) : Otto Heinemann et al

It is certified that error appears in the above-identified patent and that said Letters Patent is hereby corrected as shown below:

In column 4, line 42, change "control" to -- central -- ;

line 47, change "clone-upper" to -- clone-like upper -- ;

line 50, after "adjacent" insert -- separator -- .

In column 5, line 52, change "it" to -- its -- .

In column 6, line 2, change "at" to -- as -- ; line 5, change "sunstantially" to -- substantially -- .

Signed and Sealed this

Twenty-ninth Day of November, 1988

*Attest:*

DONALD J. QUIGG

*Attesting Officer*

*Commissioner of Patents and Trademarks*